US006108930A

United States Patent [19]

Griffin et al.

[11] Patent Number: 6,108,930

[45] Date of Patent: Aug. 29, 2000

[54] APPARATUS FOR CONTROLLING WIDTHWISE EXPANSION OF A CONVEYED WEB

[75] Inventors: Wayne C. Griffin, Livonia; Theodore R. Boccuzzi, Penfield; Edward G. Soos, Middleport, all of N.Y.

[73] Assignee: Eastman Kodak Company, Rochester, N.Y.

[21] Appl. No.: 09/274,418

[22] Filed: Mar. 23, 1999

[51] Int. Cl.[7] ..... D06F 58/00

[52] U.S. Cl. ..... 34/117; 34/120; 34/121; 34/118; 34/123; 34/126; 162/353

[58] Field of Search ..... 34/113, 116, 117, 34/118, 120, 121, 123, 126; 162/290, 375, 353, 193

[56] References Cited

U.S. PATENT DOCUMENTS

| | | | |
|---|---|---|---|
| 3,929,065 | 12/1975 | Csordas et al. | 100/90 |
| 4,263,724 | 4/1981 | Vits | 34/62 |
| 4,426,795 | 1/1984 | Rudt | 34/116 |
| 4,649,964 | 3/1987 | Smith | 139/383 A |
| 4,677,763 | 7/1987 | Kotitschke et al. | 34/116 |
| 4,686,777 | 8/1987 | Cooke | 34/116 |
| 4,698,918 | 10/1987 | Kotitschke et al. | 34/116 |
| 4,854,053 | 8/1989 | Skaugen | 34/117 |
| 4,908,958 | 3/1990 | Sollinger et al. | 34/121 |
| 5,020,242 | 6/1991 | Mayer et al. | 34/115 |
| 5,135,461 | 8/1992 | Corey et al. | 493/7 |
| 5,312,523 | 5/1994 | Eriksen et al. | 162/274 |
| 5,355,593 | 10/1994 | Kotitschke | 34/117 |
| 5,560,123 | 10/1996 | Eskelinen | 34/414 |
| 5,678,816 | 10/1997 | Marschke et al. | 271/42 |
| 5,771,603 | 6/1998 | Kotitschke et al. | 34/446 |
| 5,778,555 | 7/1998 | Lehtinen et al. | 34/71 |
| 5,782,009 | 7/1998 | Kotitschke | 34/117 |
| 5,867,919 | 2/1999 | Retulainen | 34/71 |
| 5,933,977 | 8/1999 | Deshpande et al. | 34/116 |
| 5,933,981 | 8/1999 | Meschenmoser | 34/456 |
| 5,983,523 | 11/1999 | Ijas et al. | 34/445 |
| 6,009,634 | 1/2000 | Retulainen | 34/71 |

FOREIGN PATENT DOCUMENTS

| | | |
|---|---|---|
| 55-135046 | 10/1980 | Japan . |
| 5-19898 | 3/1993 | Japan . |
| 1057373 | of 0000 | United Kingdom . |

*Primary Examiner*—Denise L. Ferensic
*Assistant Examiner*—Andrea M. Joyce
*Attorney, Agent, or Firm*—Clyde E. Bailey, Sr.

[57] ABSTRACT

Apparatus for controlling widthwise contraction of a conveyed web has opposing first web carrier belts and opposing second web carrier belts forming a generally serpentine transport path for supporting opposite lateral edges of the conveyed web.

10 Claims, 6 Drawing Sheets

APPARATUS FOR CONTROLLING WIDTHWISE EXPANSION OF A CONVEYED WEB

FIELD OF THE INVENTION

The invention relates generally to the field of web conveyance. More particularly, the invention concerns controlling widthwise contraction of a conveyed web which restrains the conveyed web from shrinking during processing.

BACKGROUND OF THE INVENTION

In conventional web conveyance processes, conveyed web is exposed to various treatment protocols. These processes most typically include rollers to support the web and in some cases involve tenters to transport the web by restraining the edges.

In cases where the web is not stiff, rollers have been used to support the web. This method is inexpensive, but does not address concerns with web defect generation related to the roller contact. Defects such as scratches, surface replication/adhesion, and impressions are generated with roller contact in this method. In addition, wrap on the rollers does little to restrain the web in cases where web shrinkage due to applied tension is a concern. A variation of the roller supported conveyance is air conveyance. In this process, the web is supported by either air blown from plenums or air blown through porous rollers (as taught in Japanese Kokai Sho 55[1980]-135046). Air conveyance is disadvantaged where the web is susceptible to distortion from the air streams.

In cases where web defects and/or shrinkage is a concern, tenters have been used to avoid roller contact and provide widthwise restraint or orientation. Tenters are complex pieces of equipment with large potential for dirt generation and high installed costs. Tenters can also damage the edges where the edge of the web is fragile. Nakajima and Ono demonstrated a process for tentering sensitive webs in Japanese Kokoku HEI 5[1993]-19898. This technology is expensive and creates dirt by perforating the web edge to constrain it.

Therefore, there persists a need in the art for an apparatus that conveys web of indeterminate length that prevents the conveyed web from shrinking during processing while not damaging sensitive webs.

SUMMARY OF THE INVENTION

It is, therefore, an object of the invention to provide an apparatus that conveys web and restrains it from shrinking.

Another object of the invention is to provide an apparatus that restrains widthwise contraction of a moving web by supporting opposite lateral edges of the moving web through a generally serpentine web conveyance path.

A further object of the invention is to provide an apparatus for conveying a web during treatment that results in more surface uniformity.

An important feature of the apparatus of the invention is a generally serpentine web conveyance path that provides moving support and widthwise restraint for the web along lateral edges of the web.

To accomplish these and other objects and features of the invention, there is provided, in one aspect of the invention, an apparatus for controlling widthwise expansion of a conveyed web of indeterminate length, comprising:

a rigid frame;

a pair of opposing first web carrier belts for supporting a lateral edge of moving web and a cooperating pair of opposing second web carrier belts for supporting an opposite lateral edge of said moving web, said first and second web carrier belts being arranged on spaced apart in said frame;

means arranged in said frame for rotatably supporting and conforming said opposing first and said opposing second web carrier belts in a generally serpentine web conveyance path, said generally serpentine web conveyance path having a web ingress lip and an opposing web egress lip;

means arranged in the frame for applying tension to each of said opposing first web carrier belts and to each of said opposing second web carrier belts; and means arranged in the frame for tracking each of said pair of opposing first and said pair of opposing second web carrier belts, said means for tracking being arranged proximate to said web ingress lip and said web egress lip of said generally serpentine web conveyance path.

The apparatus of the invention has several important advantages over prior art developments including its simplicity of design, construction, and use. Moreover, the apparatus of the invention has the added advantage of improving surface uniformity of the processed web.

BRIEF DESCRIPTION OF THE DRAWINGS

These and other aspects, objects, features, and advantages of the present invention will be more clearly understood and appreciated from a review of the following detailed description of the preferred embodiments and appended claims, and by reference to the accompanying drawing. To facilitate understanding, identical reference numerals have been used, where possible, to designate identical elements that are common to the figures, and wherein:

DETAILED DESCRIPTION OF THE INVENTION

Figure 1:
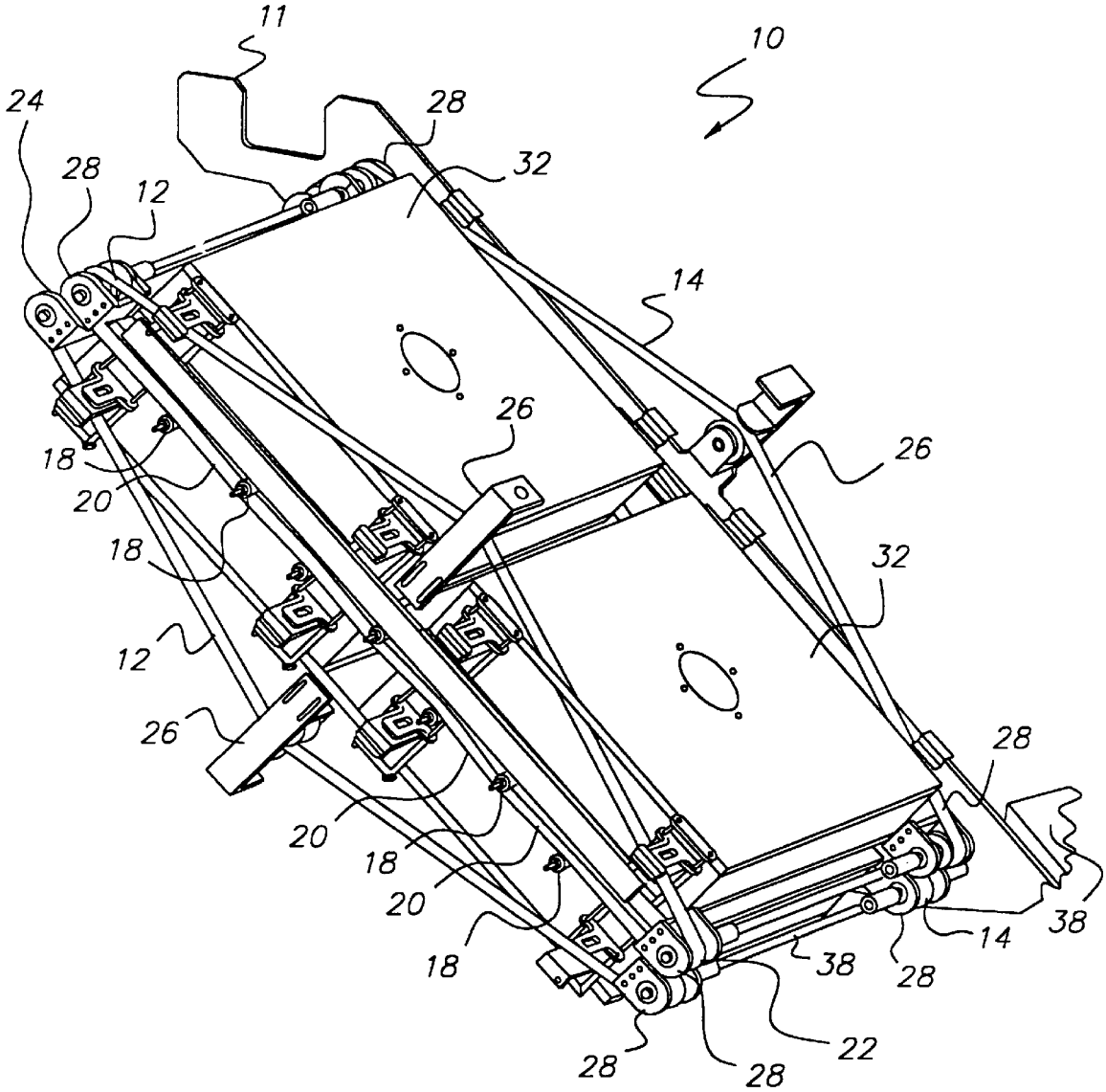
FIG. 1 is a perspective view of the apparatus of the invention.
Figure 2:
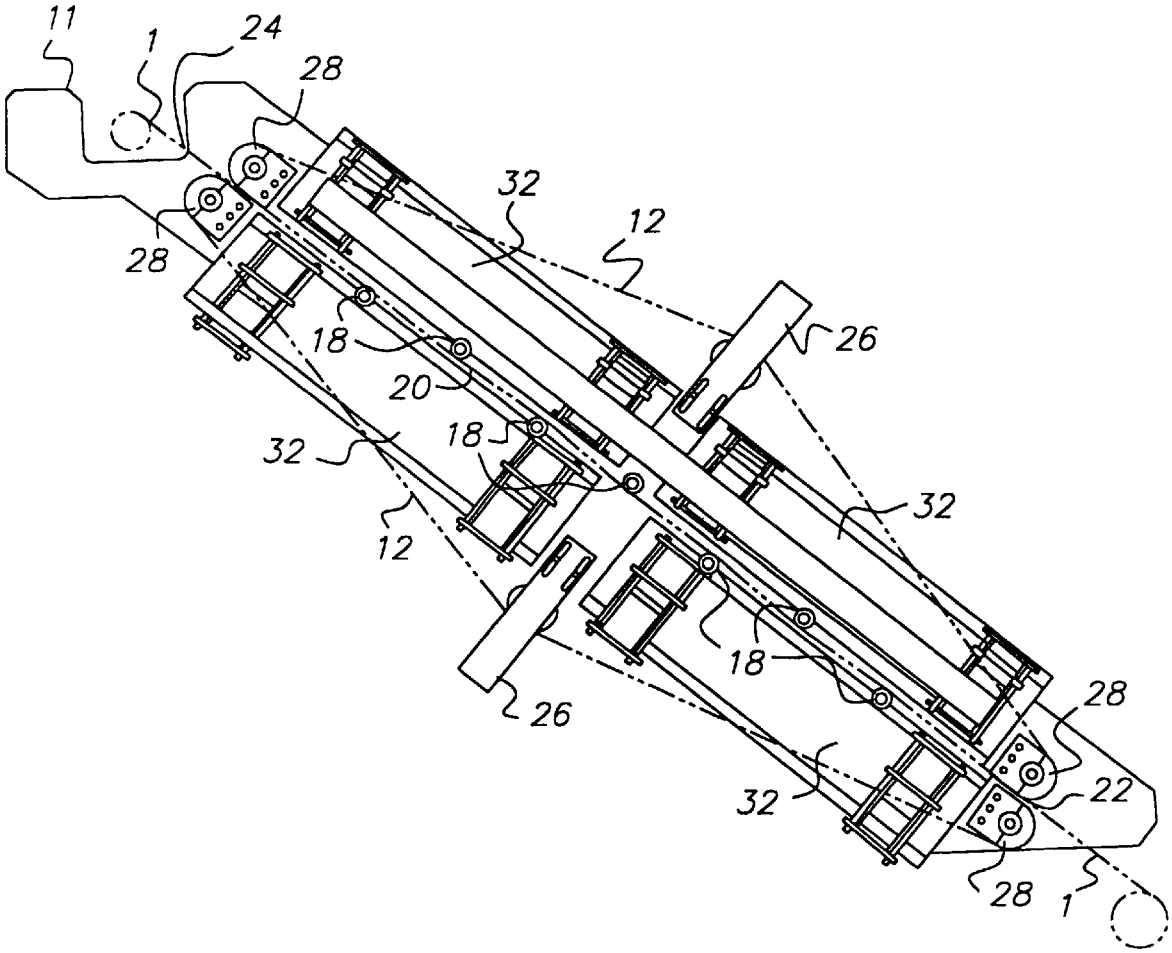
FIG. 2 is a side elevational view of the apparatus of the invention.

Turning now to the drawings and more particularly to FIGS. 1 and 2, apparatus 10 for conveying web 1 of indeterminate length is illustrated. It is useful to appreciate that web 1 may be any photographic sheet material such as solvent cast photographic film or paper having opposing lateral edges (not shown), which are tracked through a conveyance path, described herein, formed in apparatus 10.

Referring to FIG. 1, apparatus 10 includes a rigid, preferably metallic frame 11. Arranged in frame 11 is a pair of opposing first web carrier belts 12 for supporting a lateral edge (one edge shown in FIG. 6) of moving web 1. Spaced apart from opposing first web carrier belts 12 in frame 11 is a cooperating pair of similar opposing second web carrier belts 14 for supporting an opposite lateral edge (one edge shown in FIG. 6) of the moving web 1. First and second web carrier belts 12, 14 are supported by a plurality of belt support rollers 18 attached to the metallic frame 11. These belt support rollers 18 provide the path for first and second web carrier belts 12, 14. The belt support rollers 18 are in turn supported by bearings that allow them to rotate freely from the frame 11. First and second web carrier belts 12, 14 are manufactured out of materials that match the conditions of service and chemical exposure for the application. Materials such as stainless steel would work in a wide variety of applications. Applications that are sensitive to metallic dirt require polymeric carrier belt materials. Fiber reinforced materials such as reinforced butyl rubber were most preferred for this application. However, many other polymer systems would apply for different chemical environments.

Figure 3:
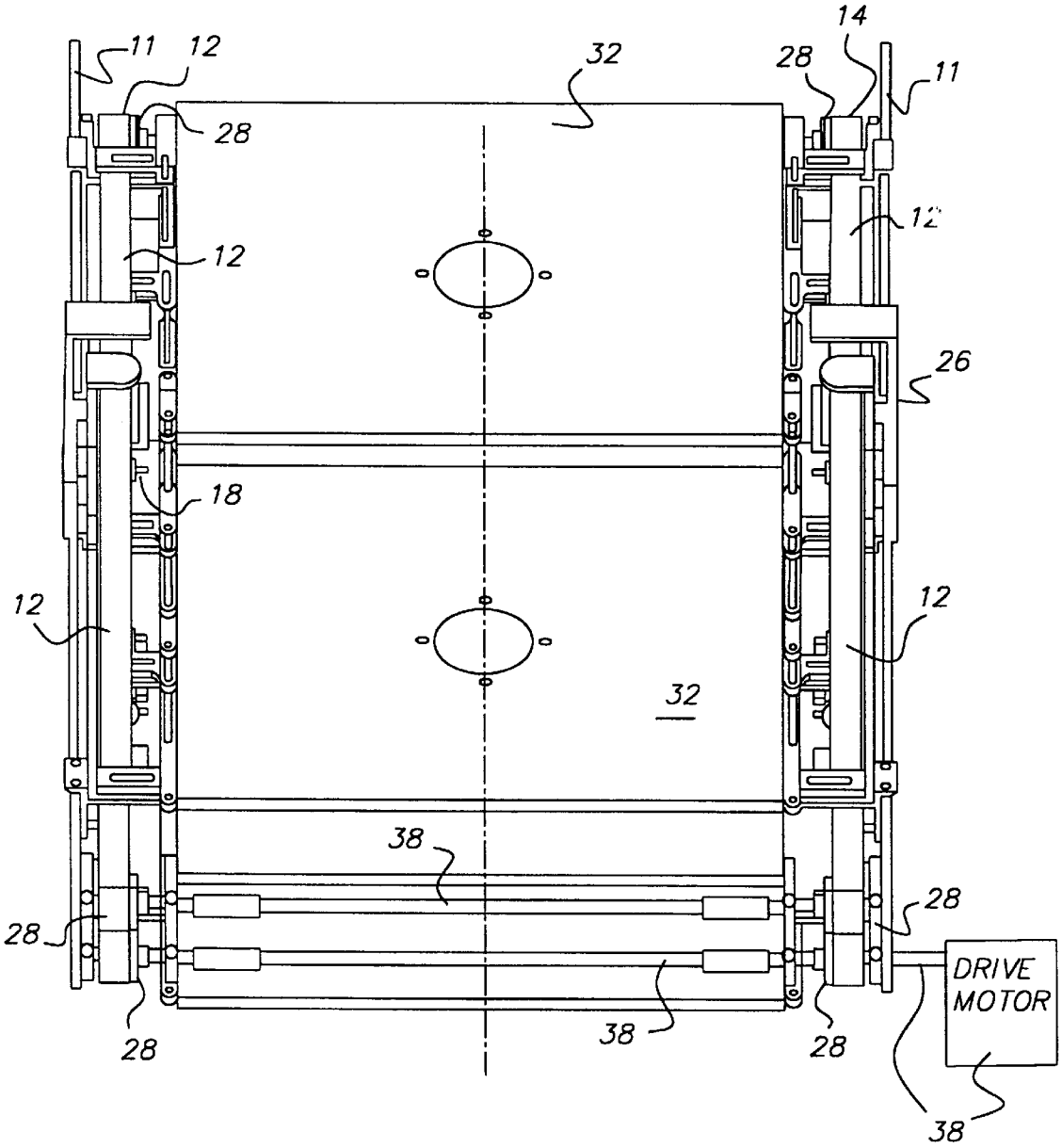
FIG. 3 is a front elevational view of the apparatus of the invention.

Referring to FIGS. 1 and 3, first and second web carrier belts 12, 14 are synchronously driven by a drive means 38, preferably a motor drive. Skilled artisans will appreciate that other means may be employed to drive first and second web carrier belts 12, 14 including the web 1.

Figure 5B:
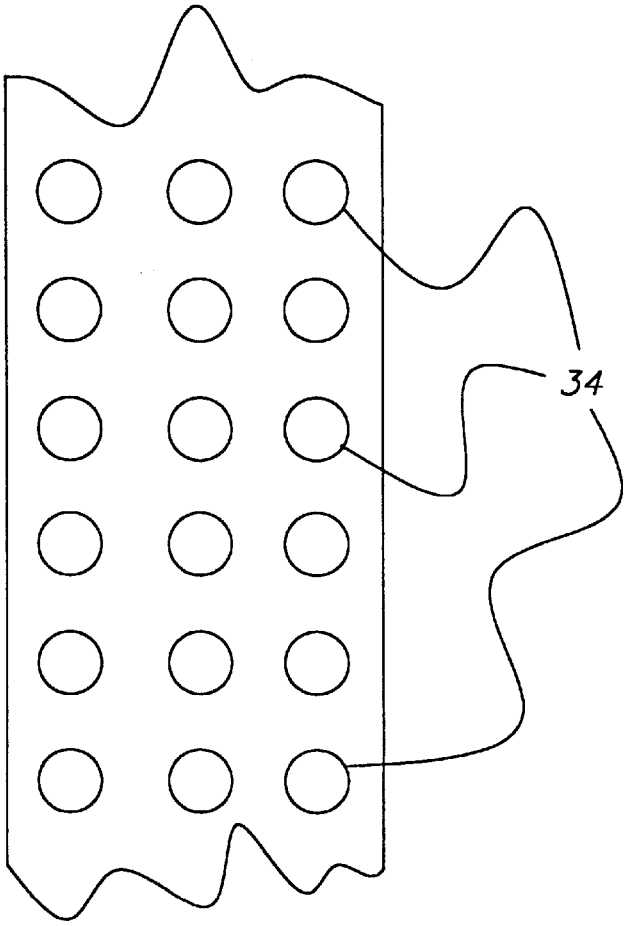
FIG. 5B is a partial plane view of a web carrier belt showing perforations therein.
Figure 5A:
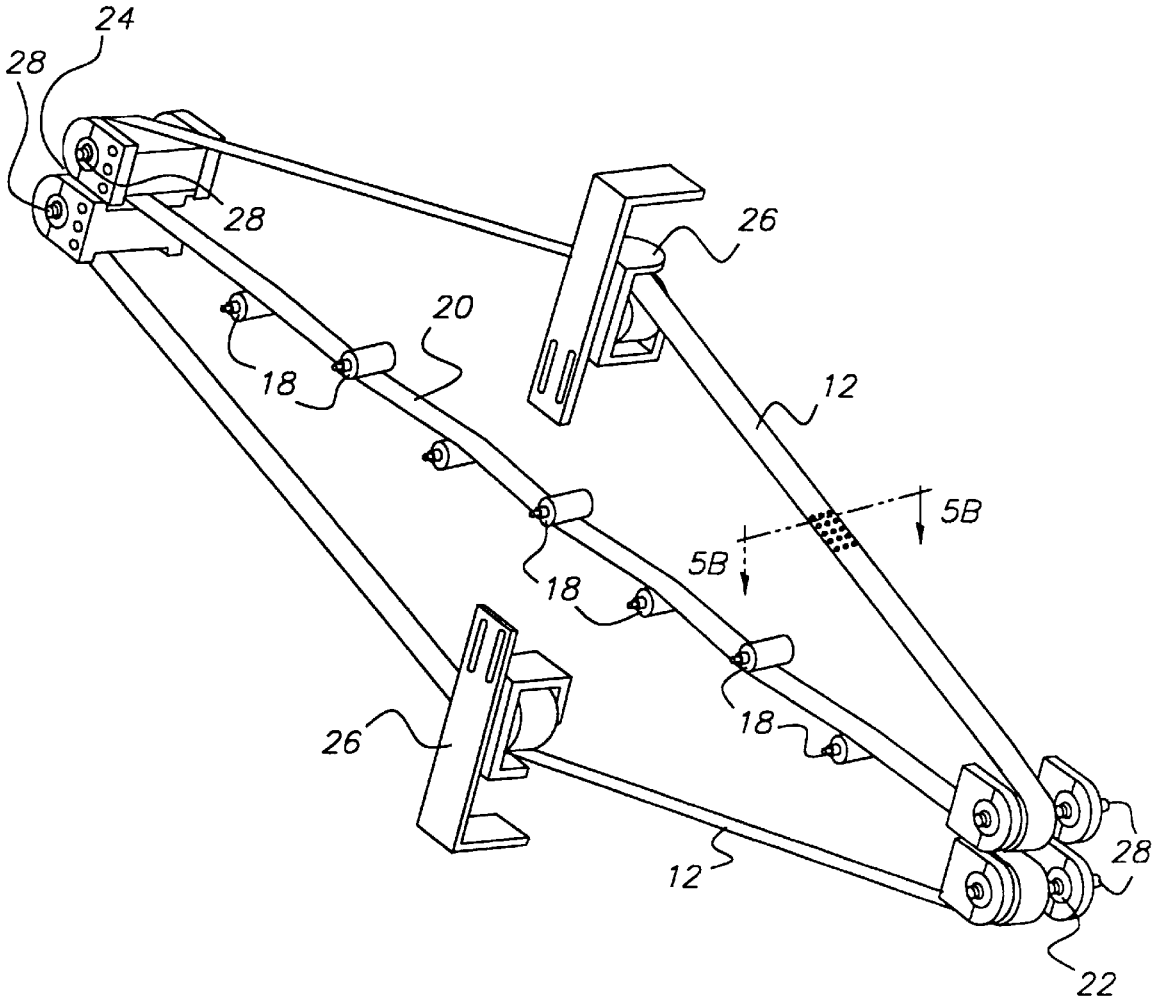
FIG. 5A is an isometric view of opposing web carrier belts.

Referring to FIG. 5, first and second web carrier belts 12, 14 each has a plurality of perforations 34 that provide two functions and advantages over prior art teachings. First, the plurality of perforations 34 provides a pathway for evaporation in solvent casting applications. Second, the perforations 34 increase the force required to shrink the web 1 while it is supported on first and second web carrier belts 12, 14.

According to our invention, opposing first web carrier belts 12 and opposing second web carrier belts 14 may have a thickness in the range of about 0.003 inches to about 0.125 inches, 0.090 inches being preferred.

Figure 6:
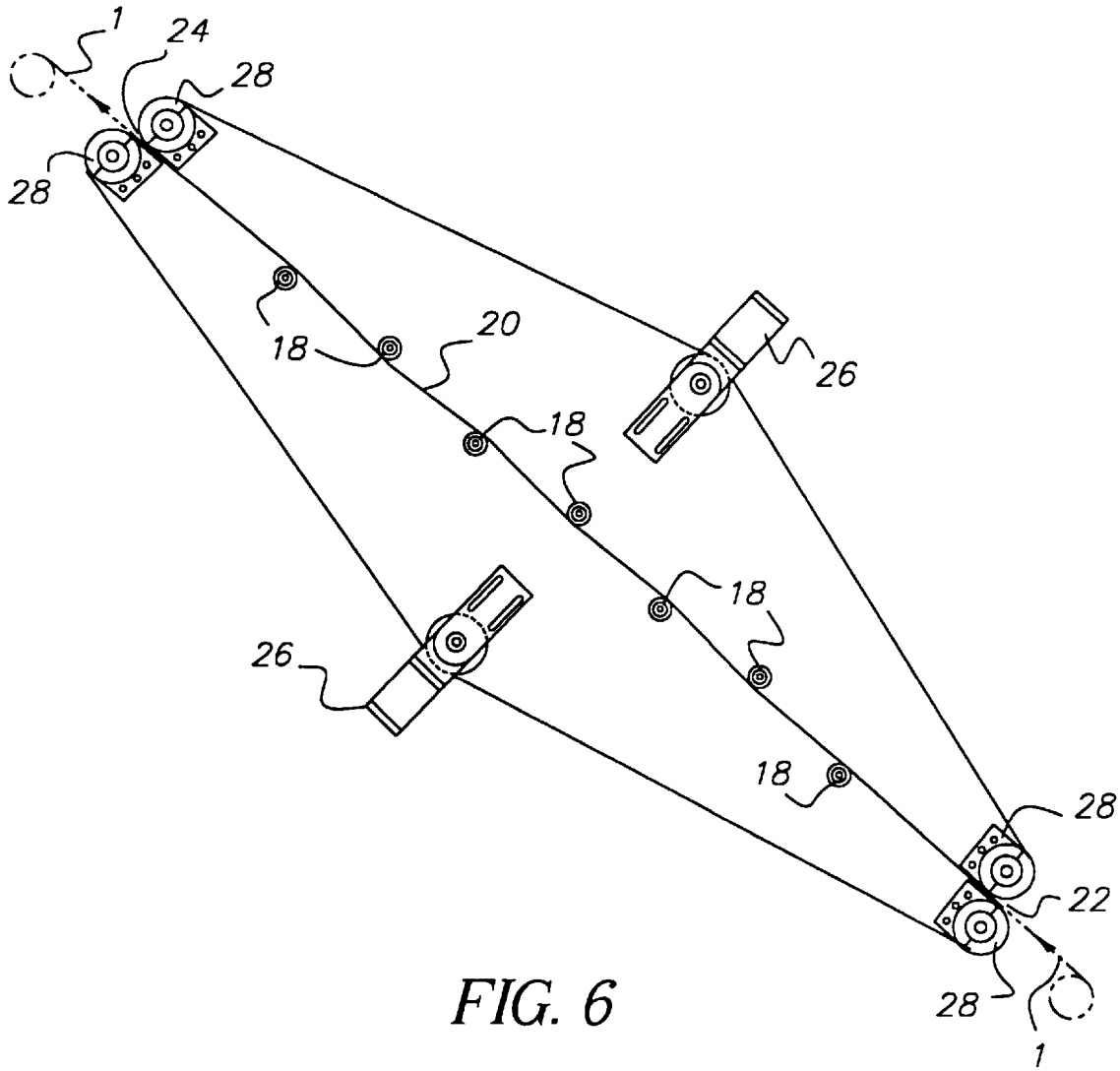
FIG. 6 is a side elevational view of opposing web carrier belts.

Referring to FIGS. 1 and 6, means is provided for rotatably supporting and conforming the opposing first web carrier belts 12 and the opposing second web carrier belts 14 in a generally serpentine web conveyance path 20 having a web ingress lip 22 and an opposing web egress lip 24. The serpentine path 20 is accomplished by offsetting opposing pairs of belt support rollers 18 from the centerline of the web in an alternating manner. The purpose of providing the serpentine path 20 is to create compressive force between opposing first web carrier belts 12 and opposing second web carrier belts 14 at the point of the belt support rollers 18 and thereby create a restraining force to restrict web shrinkage.

Figure 7:
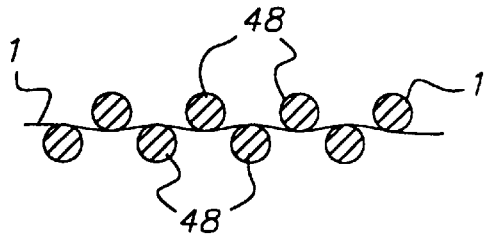
FIG. 7 is an alternate embodiment of a method of forming a serpentine path.

Referring to FIG. 7, an alternative method for forming a serpentine web conveyance path includes providing a plurality of spaced offset support rollers 48 for exerting tension on the web 1 thereby conforming the web 1 to a serpentine path. In this case, the web 1 itself forms the serpentine path rather than following a serpentine path formed by first and second web carrier belts 12, 14 described above.

Figure 4:
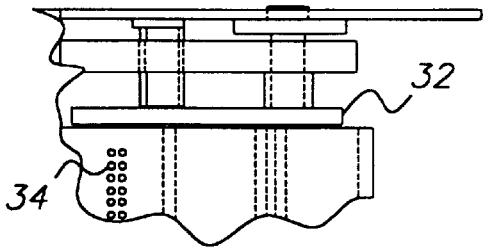
FIG. 4 is a partial plan view showing plenum perforations in phamtom.

Referring to FIGS. 1, 3, and 4, a plenum 32 for receiving forced air is arranged in close proximity to the generally serpentine web conveyance path 20 in fluid communications with a plurality of perforations 34. This arrangement of plenum 32 and perforations 34 provides fluid transfer between the plenum 32 and the web 1 moving through the generally serpentine web conveyance path 20. An advantage of supplying plenum 32 is to provide heat transfer and/or mass transfer to and from the moving web 1.

Referring to FIGS, 1–3, 5, and 6, means 26 is provided for applying tension to each of the opposing first web carrier belts 12 and to each of the opposing second web carrier belts 14. Tension may be applied through a variety of means including air cylinders, springs, cantilevered weight, etc. In this application, the use of air cylinders is the preferred design for simplicity.

Referring to FIG. 5, means is provided for tracking each of the pair of opposing first and the pair of opposing second web carrier belts 12, 14 (respectively). Tracking is accomplished by changing the geometry of the belt tracking rollers 28 at the web ingress and egress lips 22, 24 of frame 11 (shown in FIGS. 1 and 6). Belt tracking rollers 28 are machined to have a larger diameter in the center and a smaller diameter at the ends. These types of belt tracking rollers 28 are known as chamfered rollers. In our invention, opposing belt tracking rollers 28 are arranged in proximate contact with one another at both the web ingress lip 22 and web egress lip 24.

The invention has been described with reference to a preferred embodiment. However, it will be appreciated that variations and modifications can be effected by a person of ordinary skill in the art without departing from the scope of the invention.

PARTS LIST

1 web
10 apparatus
11 frame
12 opposing first web carrier belt
14 opposing second web carrier belt
18 belt support rollers
20 web conveyance path
22 web ingress lip
24 web egress lip
26 tension means
28 belt tracking rollers
32 plenum
34 perforations
38 drive means
48 offset support rollers

What is claimed is:

1. Apparatus for controlling widthwise contraction of moving web, comprising:

a frame;

a pair of opposing first web carrier belts for supporting a lateral edge of moving web and a cooperating pair of opposing second web carrier belts for supporting an opposite lateral edge of said moving web, said first and second web carrier belts being spaced apart in said frame;

means arranged in said frame for rotatably supporting and conforming said opposing first and said opposing second web carrier belts in a generally serpentine web conveyance path, said generally serpentine web conveyance path having a web ingress lip and an opposing web egress lip;

means arranged in said frame for applying tension to each of said opposing first web carrier belts and to each of said opposing second web carrier belts; and means arranged in said frame for tracking each of said pair of opposing first and said pair of opposing second web carrier belts, said means for tracking being arranged proximate to said web ingress lip and said web egress lip of said generally serpentine web conveyance path.

2. The apparatus recited in claim 1 further comprising means for synchronously driving said opposing first web carrier belts and said opposing second web carrier belts.

3. The apparatus recited in claim 1 wherein said means for rotatably supporting said opposing first web carrier belts comprises a plurality of first conveyance rollers, and means for rotatably supporting said opposing second web carrier belts comprises a plurality of second conveyance rollers.

4. The apparatus recited in claim 3 wherein each one of said plurality of first and second conveyance rollers is chamfered for tracking said pair of opposing first and said pair of opposing second web carrier belts, respectively, in said generally serpentine web conveyance path.

5. The apparatus recited in claim 1 wherein each of said pair of opposing first and said pair of opposing second web carrier belts comprises a polymeric material selected from the group consisting of: polyimide, polyester, polyurethane, and butyl rubber.

6. The apparatus recited in claim 5 wherein said polymeric materials comprise a reinforcing material.

7. The apparatus recited in claim 1 wherein each of said opposing first and said opposing second web carrier belts comprise a metal material selected from the group consisting of: stainless steel, carbon steel, polymer-coated steel, or monel.

8. The apparatus recited in claim 1 wherein each of said opposing first and said opposing second web carrier belts comprise a plurality of perforations, and wherein a plenum is arranged in close proximity to said generally serpentine web conveyance path in fluid communications with said plurality of perforations for providing fluid transfer between said plenum and said moving web traveling through said generally serpentine web conveyance path.

9. The apparatus recited in claim 1 wherein each of said opposing first web carrier belts and said opposing second web carrier belts has a thickness in the range between about 0.003 inches to about 0.125 inches.

10. The apparatus recited in claim 1 wherein each of said opposing first web carrier belts and said opposing second web carrier belts has a thickness of about 0.090 inches.

* * * * *